US009444168B2

(12) United States Patent
Horiuchi et al.

(10) Patent No.: US 9,444,168 B2
(45) Date of Patent: Sep. 13, 2016

(54) SOCKET TERMINAL

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Kanji Horiuchi, Mie (JP); Kensaku Takata, Mie (JP); Masafumi Uno, Mie (JP); Yoshitomo Tsujii, Mie (JP); Katsuhiko Aizawa, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/397,909

(22) PCT Filed: May 20, 2013

(86) PCT No.: PCT/JP2013/063932

§ 371 (c)(1),
(2) Date: Oct. 30, 2014

(87) PCT Pub. No.: WO2013/179933

PCT Pub. Date: Dec. 5, 2013

(65) Prior Publication Data

US 2015/0126076 A1 May 7, 2015

(30) Foreign Application Priority Data

May 28, 2012 (JP) ..... 2012-120549

(51) Int. Cl.
*H01R 13/15* (2006.01)
*H01R 13/18* (2006.01)

(Continued)

(52) U.S. Cl.
CPC ..... *H01R 13/18* (2013.01); *H01R 13/111* (2013.01); *H01R 24/76* (2013.01)

(58) Field of Classification Search
CPC .... H01R 13/18; H01R 24/76; H01R 13/111; H01R 13/68; H01R 13/187; H01R 13/64
USPC ..... 439/691
See application file for complete search history.

(56) References Cited

U.S. PATENT DOCUMENTS

| | | | | |
|---|---|---|---|---|
| 7,374,460 | B1 * | 5/2008 | Hariharesan | H01R 13/64 439/679 |
| 7,479,028 | B1 * | 1/2009 | Pottrff | H01R 13/58 439/472 |
| 8,128,441 | B2 * | 3/2012 | Mukuno | H01R 13/187 439/845 |

(Continued)

FOREIGN PATENT DOCUMENTS

| | | |
|---|---|---|
| JP | 2003317843 | 11/2003 |
| JP | 2010113962 | 5/2010 |
| JP | 2012022826 | 2/2012 |

OTHER PUBLICATIONS

International Search Report dated Jun. 11, 2013.

*Primary Examiner* — Jean F Duverne
(74) *Attorney, Agent, or Firm* — Gerald E. Hespos; Michael J. Porco; Matthew T. Hespos

(57) ABSTRACT

A socket terminal (10) to be fitted and connected to a mating pin terminal (20) includes a tubular portion (11) to be fitted to the pin terminal (20). The tubular portion (11) includes a base portion (12) provided on a side opposite to a fitting starting end to the pin terminal (20) and a plurality of terminal pieces (13) extending in an axial direction of the tubular portion (11) from the base portion (12) toward the pin terminal (20), spaced apart in a circumferential direction of the tubular portion (11) and capable of resiliently coming into contact with the outer peripheral surface of the pin terminal (20) fitted in the tubular portion (11). The base portion (12) includes a plurality of terminal pieces (16) projecting toward the pin terminal (20) radially of the tubular portion (11) and configured to hold the outer peripheral surface of the pin terminal (20).

16 Claims, 21 Drawing Sheets

(51) Int. Cl.
*H01R 13/11* (2006.01)
*H01R 24/76* (2011.01)

(56) References Cited

U.S. PATENT DOCUMENTS 8,308,516 B2 * 11/2012 Gassaur et al. ..... H01R 4/48 439/817
8,678,867 B2 * 3/2014 Glick ..... H01R 13/187 439/843
8,864,535 B2 * 10/2014 Gingrich, III ..... H01R 4/48 439/862
8,998,655 B2 * 4/2015 Glick ..... H01R 13/187 439/839
2014/0134890 A1 * 5/2014 Kobayashi ..... H01R 13/11 439/691

* cited by examiner

SOCKET TERMINAL

BACKGROUND

1. Field of the Invention

The present invention relates to a socket terminal.

2. Description of the Related Art

A known socket terminal is shown in FIG. 21 and is described in Japanese Unexamined Patent Publication No. 2010-113962. This known socket terminal is to be accommodated in a cavity formed in a housing made of resin. With reference to FIG. 21, the socket terminal 1 includes a tubular portion 3 into which a mating pin terminal 2 is to be inserted, and the tubular portion 3 includes an annular base portion 4 and a plurality of terminal pieces 5 extending from the base portion 3 toward the mating pin terminal 2. Tip sides of the terminal pieces 5 are slightly narrowed, the pin terminal 2 is inserted into the tubular portion 3 while resiliently deforming the terminal pieces 5 to expand the terminal pieces 5 and electrical connection is established at a contact point of the pin terminal 2 and the socket terminal In the conventional socket terminal 1 described above, the pin terminal 2 and the socket terminal 1 are resiliently in contact with each other on the same plane (Y-plane of FIG. 21) in an axial direction of the tubular portion 3 (pin terminal 2) and are electrically conductively connected. Thus, if an external force is radially applied to the pin terminal 2 due to vibration or the like, a center axis of the pin terminal 2 is inclined with respect to that of the tubular portion 3, with the result that the contact point of the pin terminal 2 and the socket terminal 1 may move to change contact resistance.

The present invention was completed based on the above situation and aims to provide a socket terminal capable of stably holding a pin terminal.

SUMMARY OF THE INVENTION

To solve the above problem, the present invention is directed to a socket terminal to be fitted and connected to a mating pin terminal, the socket terminal including a tubular portion to be fitted to the pin terminal, wherein the tubular portion includes a base portion provided on a side opposite to a fitting starting end to the pin terminal and a plurality of terminal pieces extending in an axial direction of the tubular portion from the base portion toward the pin terminal, spaced apart in a circumferential direction of the tubular portion and capable of resiliently coming into contact with the outer peripheral surface of the pin terminal fitted in the tubular portion; and the base portion includes a plurality of holding portions projecting toward the pin terminal radially of the tubular portion and configured to hold the outer peripheral surface of the pin terminal.

According to the socket terminal of the present invention, since a base side of the pin terminal is resiliently held in contact with the plurality of terminal pieces and the tip side thereof is held by the plurality of holding portions provided on the base portion of the tubular portion, the pin terminal is held at least at two positions in the axial direction of the socket terminal (tubular portion). Thus, even if an external force is radially applied to the pin terminal, the pin terminal is not easily inclined with respect to the socket terminal as in a conventional case and can be stably held.

Note that the holding portions may be, for example, bulging portions formed by being pressed to project from an outer peripheral surface side of the base portion or resilient pieces resiliently deformable radially outwardly of the base portion.

Further, the plurality of holding portions may be provided on the same circumference of the inner peripheral surface of the base portion. If such a configuration is adopted, stability is improved since the outer peripheral surface of the tip side of the pin terminal can be held in an equal state.

Further, the holding portions may be provided between adjacent ones of the terminal pieces of the base portion. The plurality of terminal pieces are resiliently held in contact with the base side of the pin terminal. By providing the holding portions between adjacent ones of the terminal pieces, the tip side of the pin terminal can be held on axis lines between contact portions of the terminal pieces. Thus, stability is further improved.

Furthermore, the pin terminal and the holding portions may be in an electrically insulated state. By doing so, the pin terminal and the socket terminal are electrically connected only by the contact portions of the terminal pieces, wherefore an electrically connected state can be stabilized.

According to the present invention, it is possible to stably hold a pin terminal.

DETAILED DESCRIPTION

Figure 1:
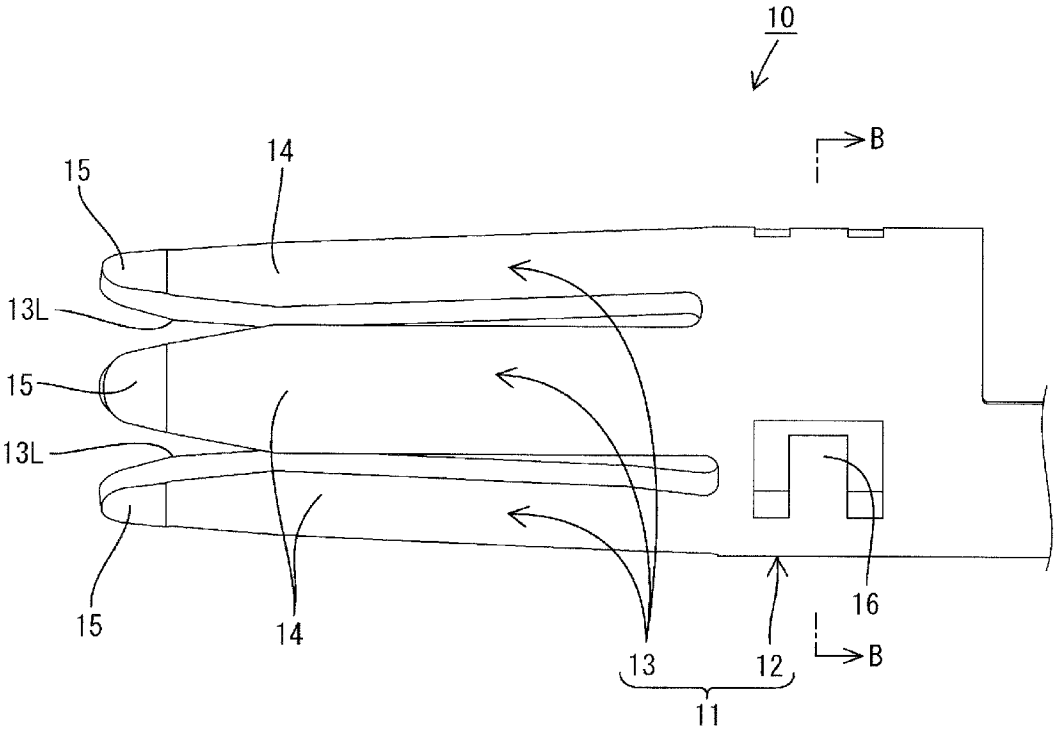
FIG. 1 is a partial side view of a socket terminal in a first embodiment of the present invention.

A first embodiment of the present invention is described with reference to FIGS. 1 to 8. A socket terminal 10 of this embodiment is fittable to a mating pin terminal 20.

The socket terminal 10 includes a tubular portion 11 provided at an end side (left side in FIG. 1) of a connecting portion (not shown) electrically conductively connectable to a core of an unillustrated wire and fittable to the mating pin terminal 20. The tubular portion 11 is formed into a substantially cylindrical shape as a whole and an axis line thereof extends in a fitting direction to the pin terminal 20. The tubular portion 11 is composed of an annular base portion 12 and a plurality of (six in this embodiment) terminal pieces 13 extending forward from this base portion 12 in the fitting direction to the pin terminal 20 (leftward in FIG. 1) and spaced apart in a circumferential direction of the tubular portion 11.

The base portion 12 is formed into an annular shape by being bent to have a substantially C-shaped cross-section so that end edges of a plate-like member made of metal butt against each other. Each terminal piece 13 is tapered, cantilevered forward from the base portion 12 in the fitting direction to the pin terminal 20 along an axial direction of the tubular portion 11 and composed of a tapered portion 14 inclined in a direction to be narrowed toward the tip side and a guiding portion 15 provided at a tip side of this tapered portion 14 to slightly thicken the terminal piece 13. The terminal piece 13 can be resiliently deflected and deformed in a radial direction of the tubular portion 11. An inner diameter near boundaries 13L between the tapered portions 14 and the guiding portions 15 in a natural state is set slightly smaller than an outer diameter of the pin terminal 20, so that the vicinities of these boundaries 13L resiliently come into contact with the outer periphery of the pin terminal 20 to be electrically conductively connected to the pin terminal 20 when the pin terminal 20 is inserted into the tubular portion 11.

Note that the socket terminal 10 is formed of a plate-like member made of metal, e.g. by press-molding a plate-like member made of copper alloy into a predetermined shape, and plating such as of silver or tin is applied to a surface thereof.

Figure 2:
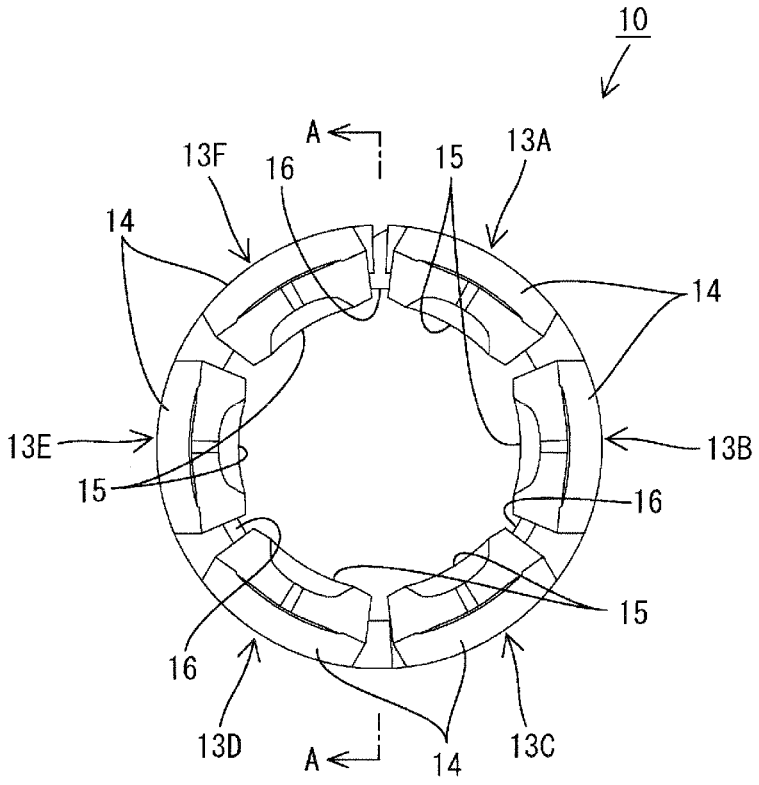
FIG. 2 is a front view of the socket terminal.
Figure 3:
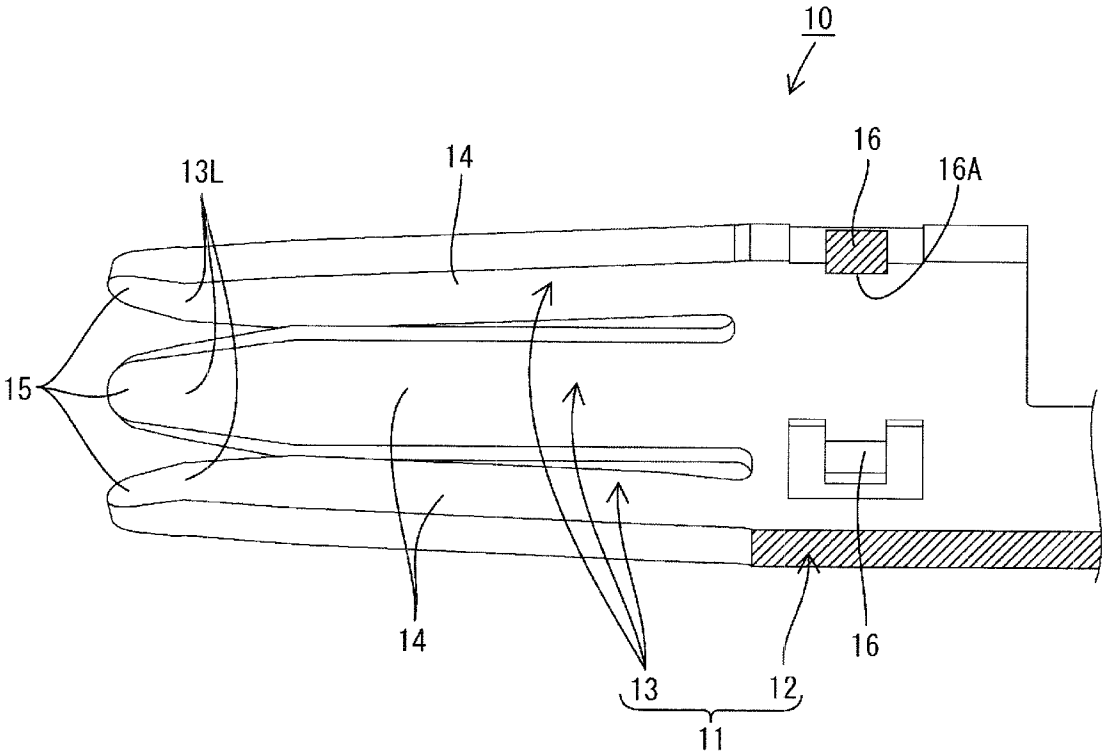
FIG. 3 is a section along A-A of FIG. 2.
Figure 4:
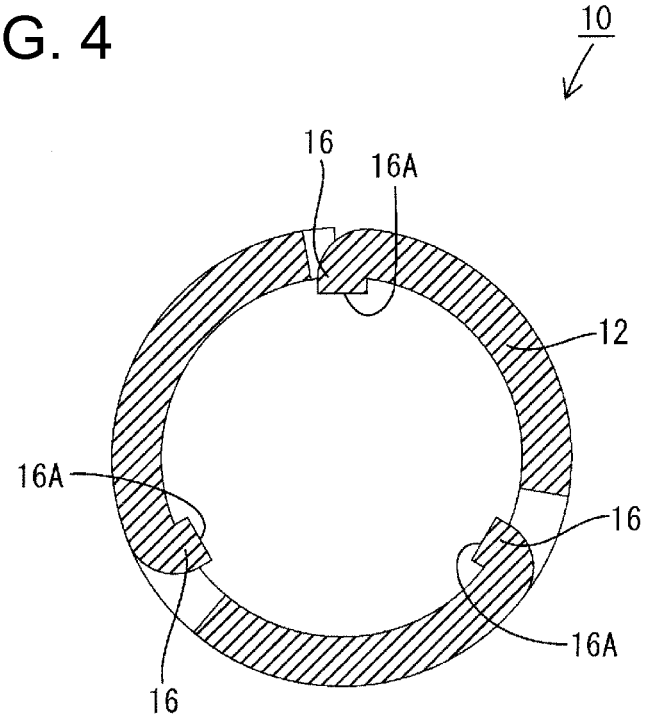
FIG. 4 is a section along B-B of FIG. 1.

The base portion 12 includes resilient holding pieces 16 (an example of holding portions and resilient pieces of the present invention). As shown in FIGS. 1 to 4, the resilient holding pieces 16 are formed by bending cantilevered resilient pieces cut along the circumferential direction of the base portion 12 radially inwardly of the tubular portion 11. Three resilient holding pieces 16 are provided at equal intervals in this embodiment. Specifically, in this embodiment, a total of six terminal pieces 13 are formed at an angular interval of 60° in the circumferential direction, whereas a total of three resilient holding pieces 16 are formed at an angular interval of 120° in the circumferential direction (see FIG. 4). These three resilient holding pieces 16 are formed to be located on axis lines between adjacent ones of the terminal pieces 13. Specifically, if the six terminal pieces 13 are successively 13A, 13B, 13C, 13D, 13E and 13F from a butting part of the base portion 12, for example, as shown in FIG. 2, the resilient holding pieces 16 are formed at three positions between the terminal pieces 13B and 13C, between the terminal pieces 13D and 13E and between the terminal pieces 13F and 13A. Note that an inner diameter of a surface formed by connecting tip surfaces 16A of the resilient holding pieces 16 in the circumferential direction of the tubular portion 11 is set equal to or slightly smaller than the outer diameter of the pin terminal 20 (see FIG. 4).

Figure 5:
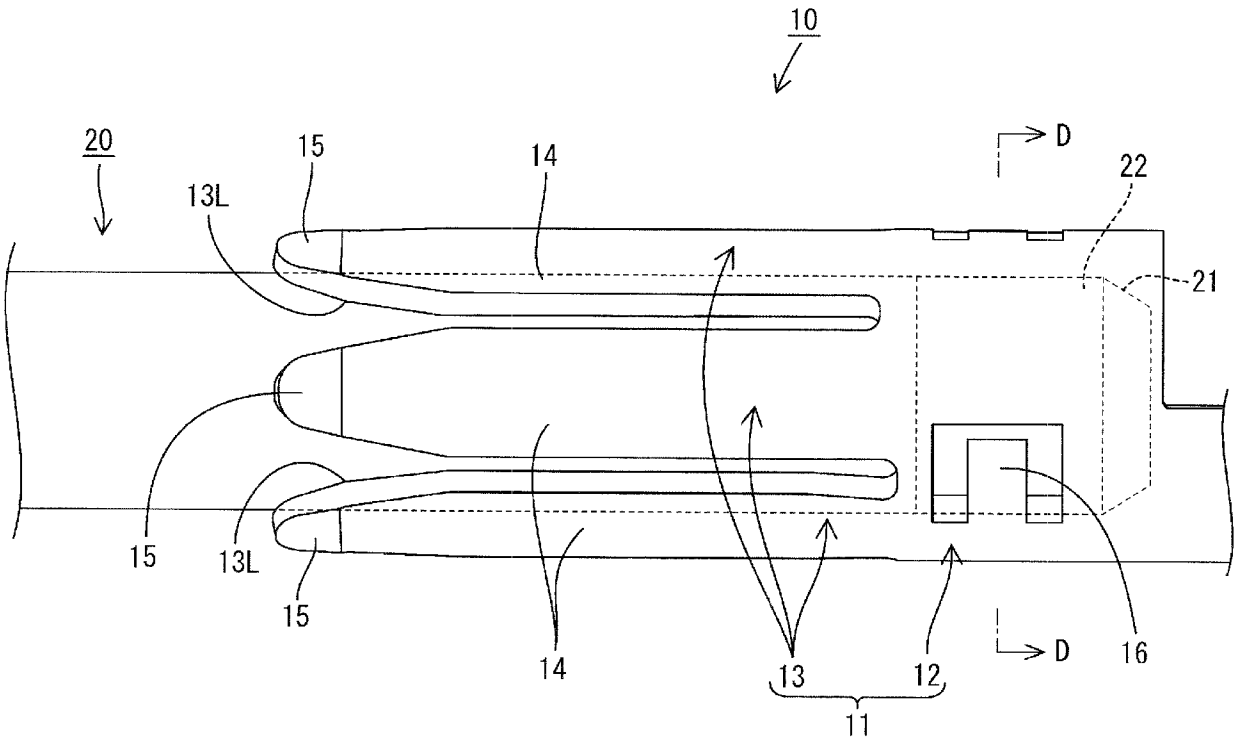
FIG. 5 is a partial side view showing a state where the socket terminal and a pin terminal are fitted.
Figure 6:
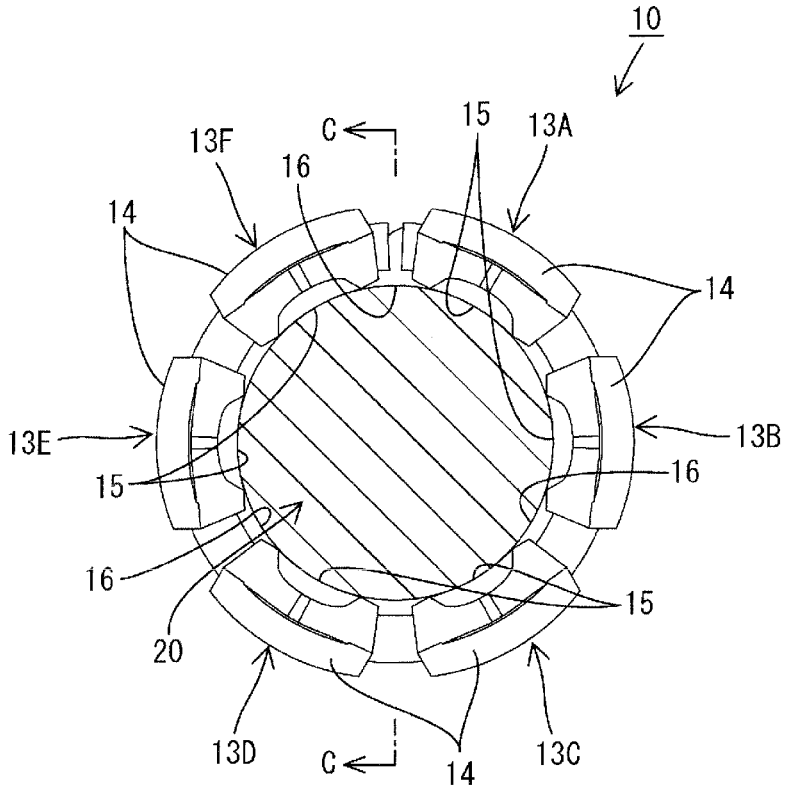
FIG. 6 is a front view showing the state of FIG. 5.
Figure 7:
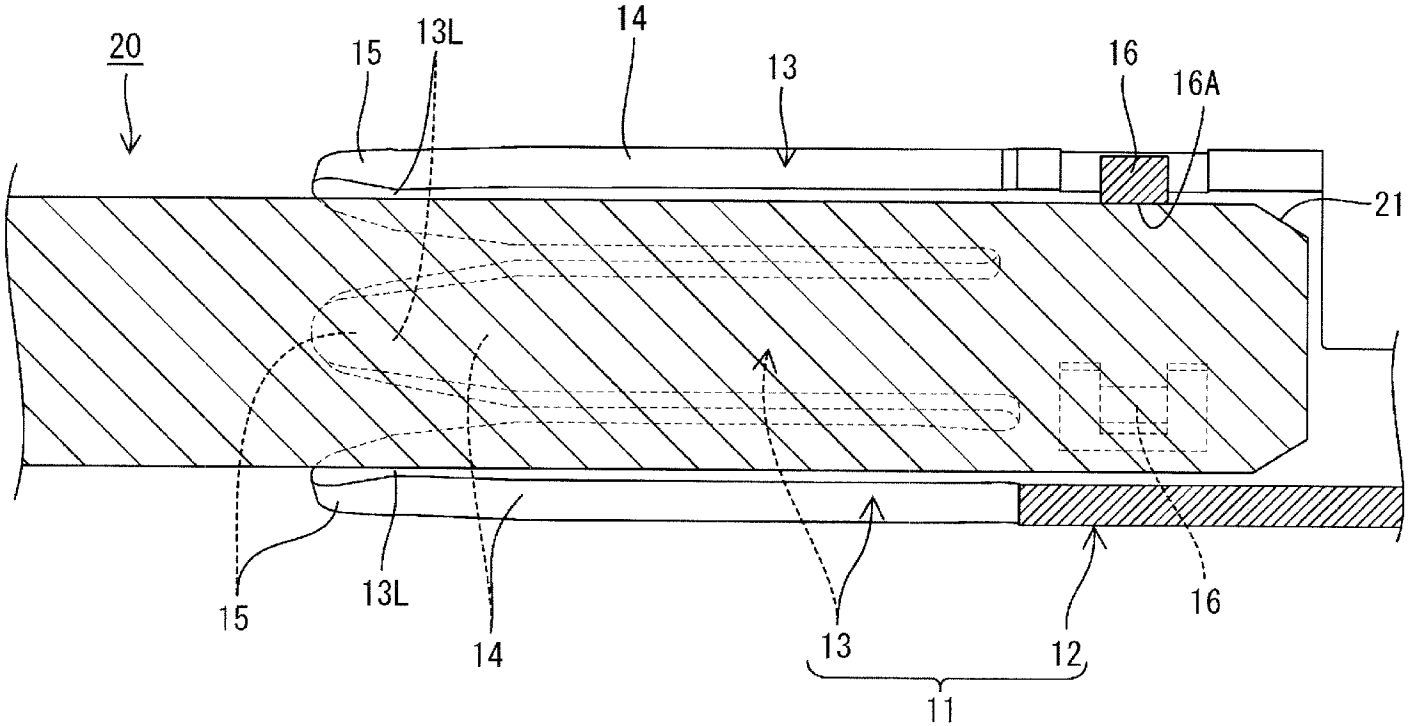
FIG. 7 is a section along C-C of FIG. 6.

On the other hand, the pin terminal 20 is formed to have a circular cross-section, for example, as shown in FIG. 6 and a slightly narrowed guiding surface 21 is formed on a tip part of the pin terminal 20 (see FIGS. 5 and 7). Further, the tip part including this guiding surface 21 is covered with an insulating member 22 for preventing finger touch. This insulating member 22 is set to have a length sufficient to cover the tip part of the pin terminal 20 at least up to a position to be brought into contact with the resilient holding pieces 16 of the socket terminal 10 when the socket terminal 10 and the pin terminal 20 are properly fitted (see FIG. 5). Note that the other end side of the pin terminal 20 is connected to an unillustrated wire or an unillustrated device.

When the socket terminal 10 of this embodiment and the pin terminal 20 are fitted, the pin terminal 20 is first inserted into the tubular portion 11 with the tip side thereof in the lead. At this time, the guiding surface 21 of the pin terminal 20 is quickly inserted into the tubular portion 11 while being guided by the guiding portions 15 of the socket terminal 10. Further, at this time, the plurality of terminal pieces 13A to 13F of the socket terminal 10 are pushed and deformed to expand by the pin terminal 20, whereby areas of the terminal pieces 13 near the boundaries 13L between the tapered portions 14 and the guiding portions 15 resiliently come into contact with the outer peripheral surface of the pin terminal 20 and the pin terminal 20 and the socket terminal 10 are electrically connected.

Figure 8:
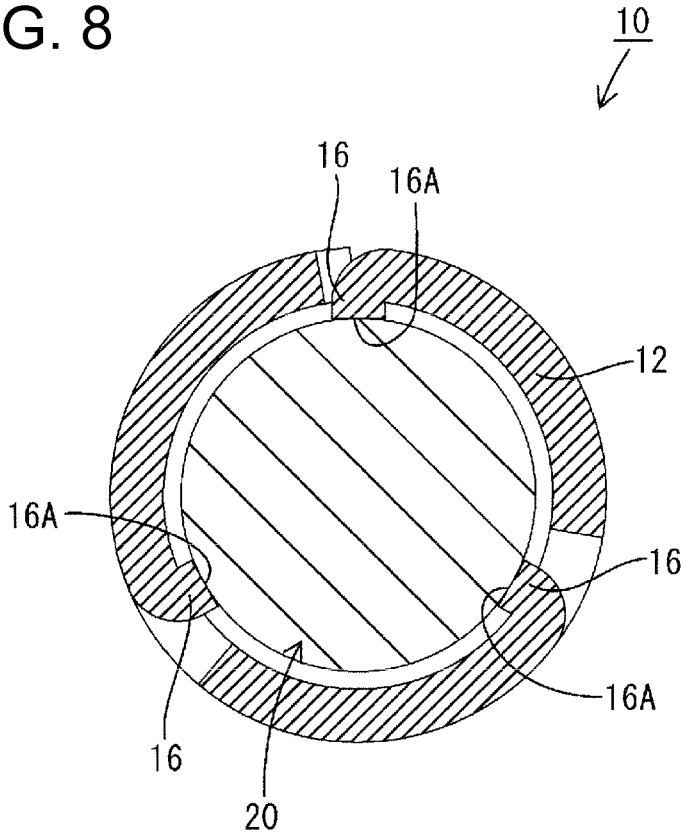
FIG. 8 is a section along D-D of FIG. 5.
Figure 9:
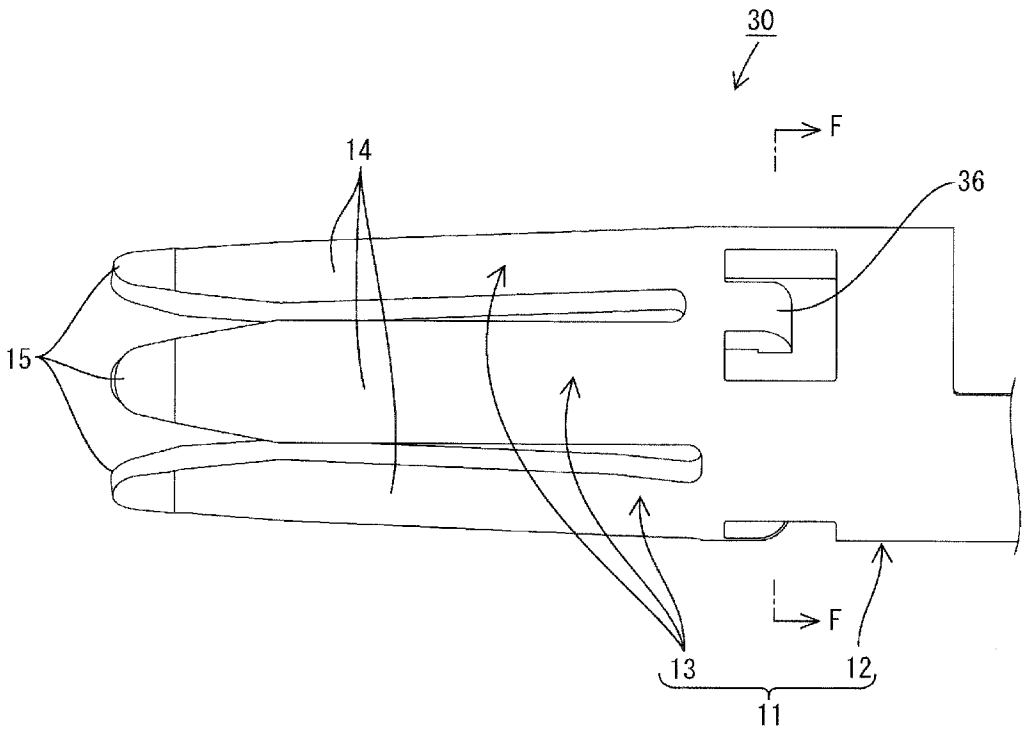
FIG. 9 is a partial side view of a socket terminal in a second embodiment of the present invention.

When the pin terminal 20 reaches a proper fitting position, the tip surfaces 16A of the resilient holding pieces 16 projecting toward an inner peripheral side of the base portion 12 come into contact or resiliently come into contact with the outer peripheral surface (more specifically, insulating member 22 covering the pin terminal 20) of the pin terminal 20 and hold the tip part of the pin terminal 20 in three directions as shown in FIGS. 7 and 8.

According to such a socket terminal 10 of this embodiment, not only the base side of the pin terminal 20 is resiliently in contact with the terminal pieces 13 of the socket terminal 10, but also the tip side thereof is held by the resilient holding pieces 16, wherefore the pin terminal 20 is held at two positions in the axial direction in the tubular portion 11. Thus, even if an external force is radially applied to the pin terminal 20, the pin terminal 20 is not twisted relative to the socket terminal 10 and the pin terminal 20 and the socket terminal 10 can be stably electrically connected.

Further, by providing the three resilient holding pieces 16 on the same circumference of the tubular portion 11 (base portion 12), i.e. at the same position in the axial direction of the tubular portion 11, the pin terminal 20 is equally radially held. Thus, a contact pressure of electrically connected parts of the pin terminal 20 and the terminal pieces 13 can be maintained constant and electrical connection between the pin terminal 20 and the socket terminal 10 can be made more stable.

Furthermore, since each of these resilient holding pieces 16 is provided on the axis line between two adjacent terminal pieces 13 out of the base portion 12, the pin terminal 20 is held at circumferentially different positions at the base side and tip side thereof. This also enables the pin terminal 20 to be more stably held in the tubular portion 11.

Further, since the insulating member 22 provided on the tip of the pin terminal 20 for preventing finger touch is utilized and the resilient holding pieces 16 are brought into contact with the insulating member 22 in this embodiment, the resilient holding pieces 16 are electrically insulated from the pin terminal 20. Thus, the socket terminal 10 and the pin terminal 20 are in contact with each other only at the tip sides of the terminal pieces 13 and an electrical contact state is stabilized.

A second embodiment of the present invention is described with reference to FIGS. 9 to 12. In this embodiment, the same components as in the above first embodiment are denoted by the same reference signs and not described.

Figure 10:
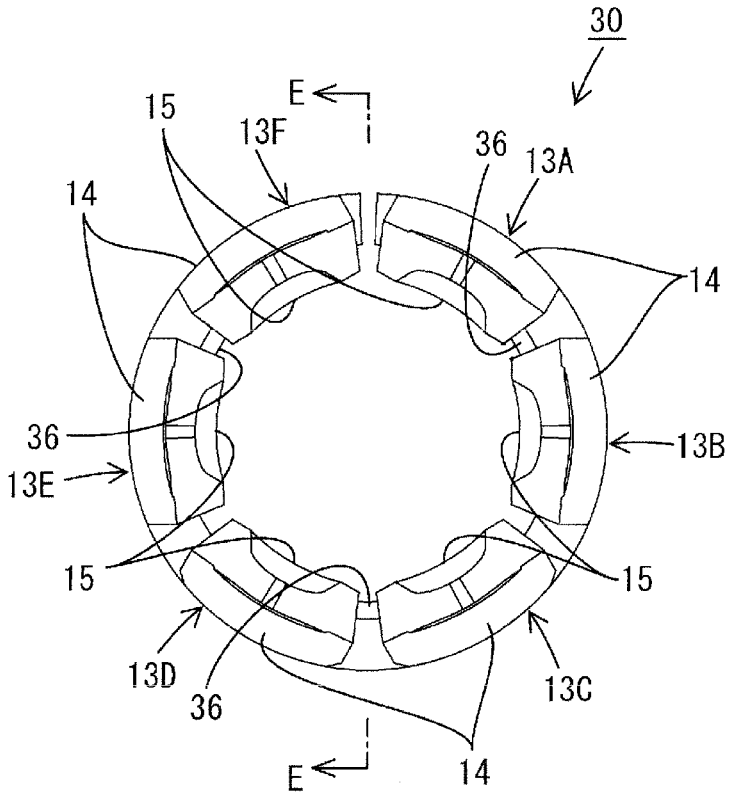
FIG. 10 is a front view of the socket terminal.
Figure 11:
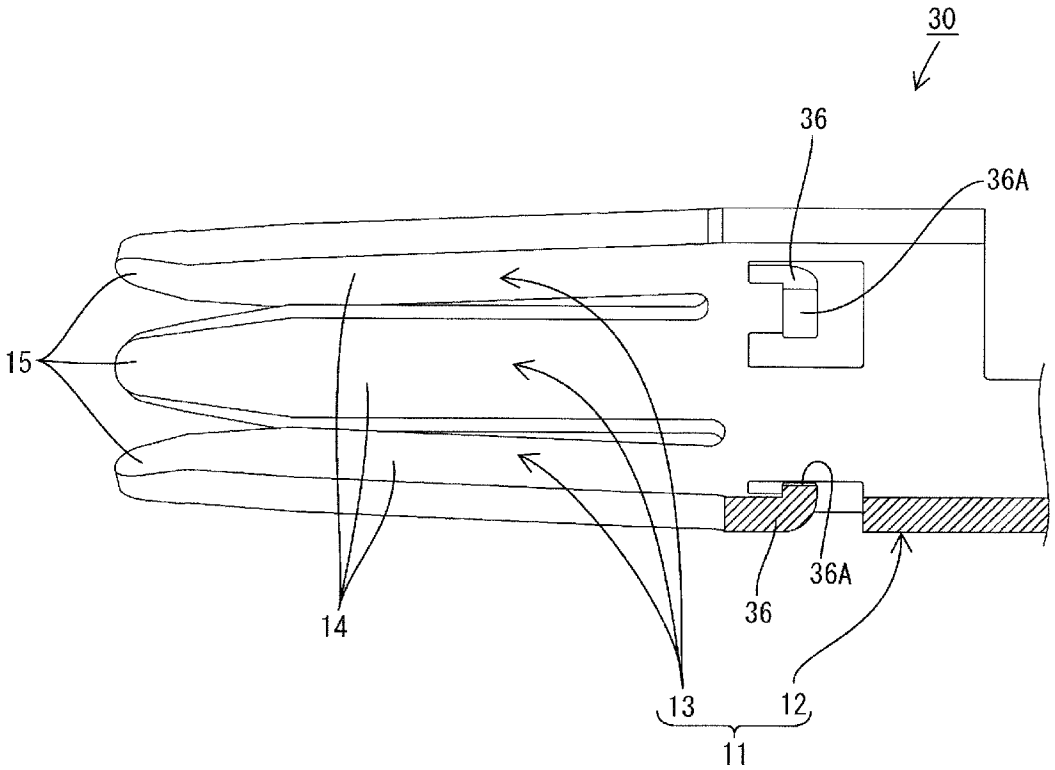
FIG. 11 is a section along E-E of FIG. 10.
Figure 12:
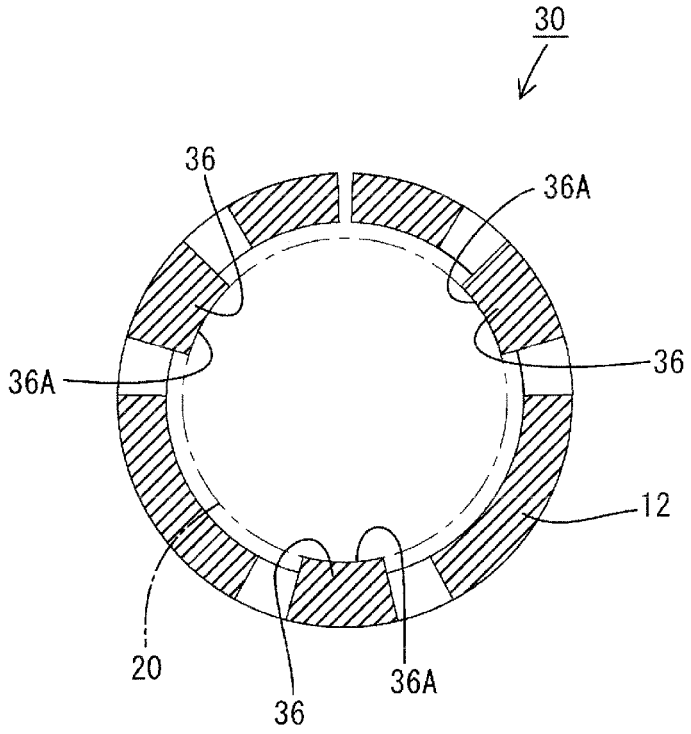
FIG. 12 is a section along F-F of FIG. 9.
Figure 13:
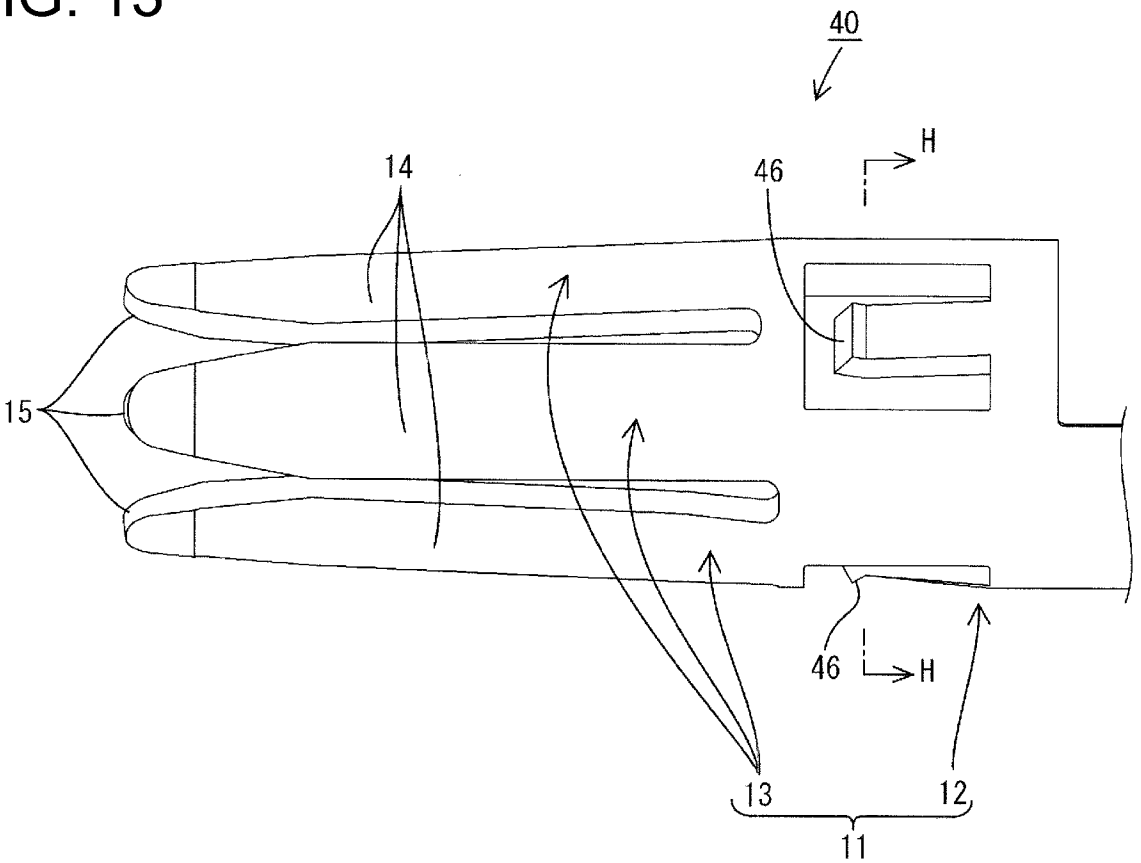
FIG. 13 is a partial side view of a socket terminal in a third embodiment of the present invention.
Figure 14:
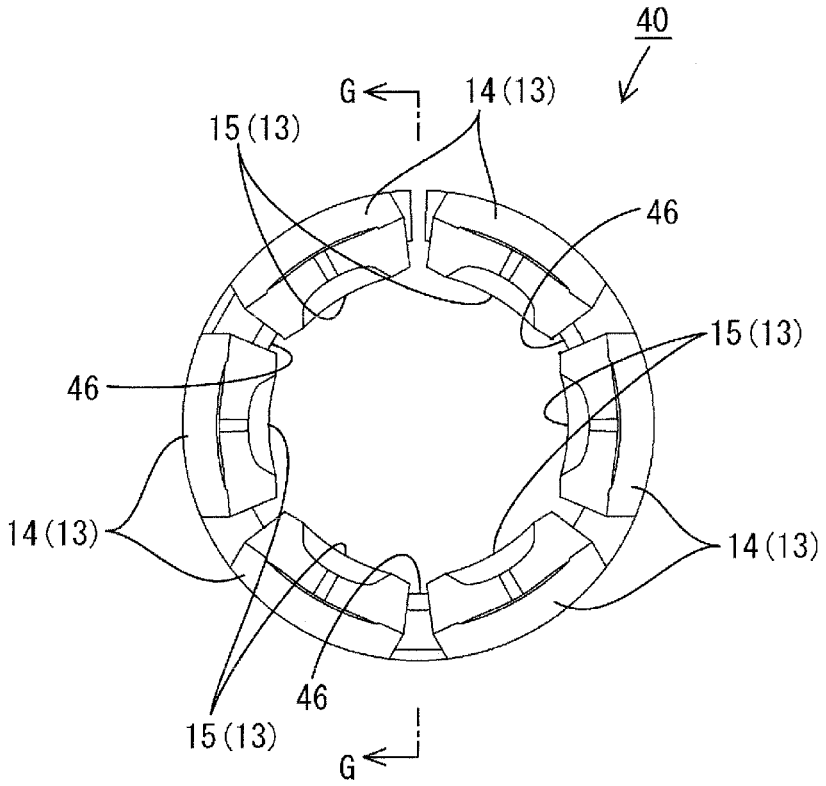
FIG. 14 is a front view of the socket terminal.

A socket terminal 30 of this embodiment is different from the first embodiment in the orientation of resilient holding pieces 36. The resilient holding pieces 36 are formed by bending tip parts of resilient pieces cut along an axial direction of a tubular portion 11 and cantilevered backward in a fitting direction substantially a right angle radially inwardly of the tubular portion 11. As in the first embodiment, a total of three resilient holding pieces 36 are formed at equal intervals in a circumferential direction, i.e. at positions circumferentially spaced apart by 120°. Further, these three resilient holding pieces 36 are formed to be located on axis lines between adjacent ones of terminal pieces 13. Specifically, if six terminal pieces 13 are successively 13A, 13B, 13C, 13D, 13E and 13F from a butting part of a base portion 12, for example, as shown in FIG. 10, the resilient holding pieces 16 are formed at three positions between the terminal pieces 13A and 13B, between the terminal pieces 13C and 13D and between the terminal pieces 13E and 13F. Note that an inner diameter of a surface formed by connecting tip surfaces 36A of the resilient holding pieces 36 in the circumferential direction of the tubular portion 11 is set equal to or slightly smaller than an outer diameter of a pin terminal 20.

Also by such a socket terminal 30 of this embodiment, the pin terminal 20 and the socket terminal 30 can be stably electrically connected as in the above first embodiment.

Figure 15:
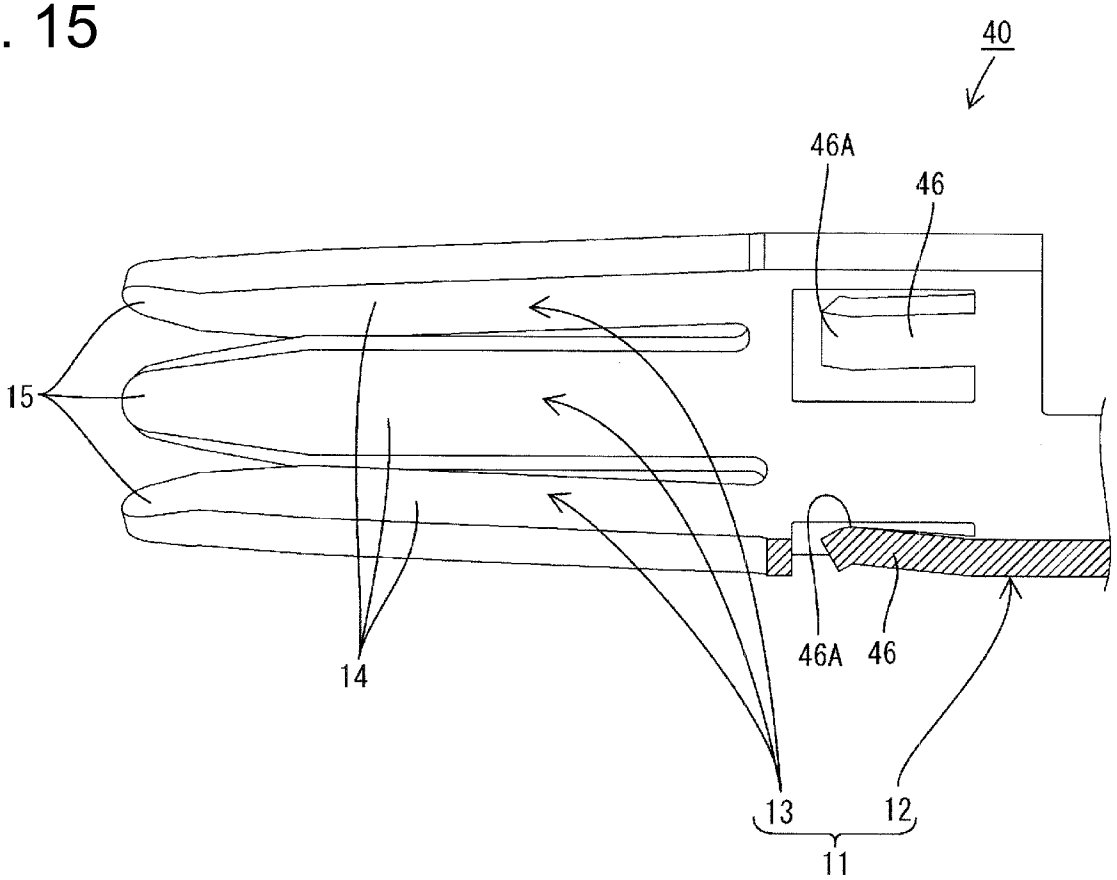
FIG. 15 is a section along G-G of FIG. 14.
Figure 16:
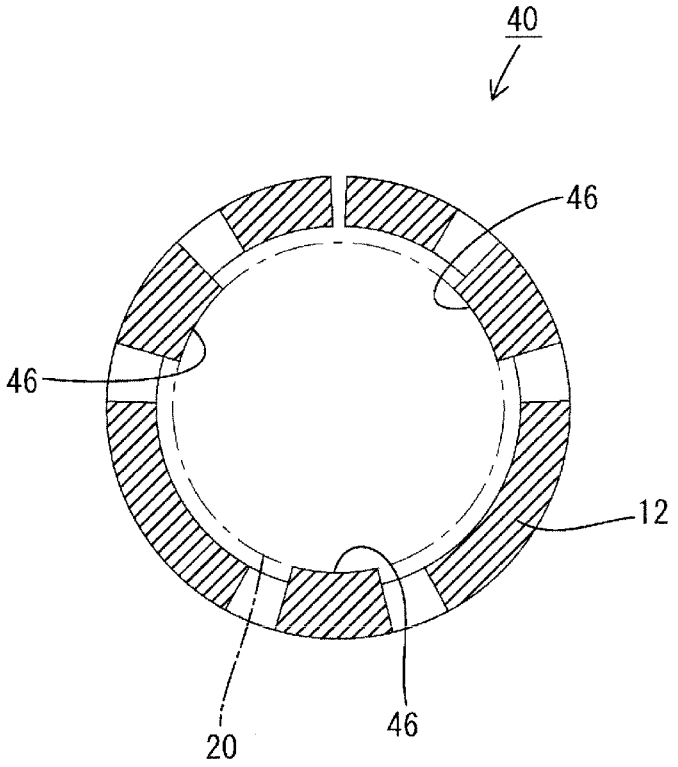
FIG. 16 is a section along H-H of FIG. 13.
Figure 17:
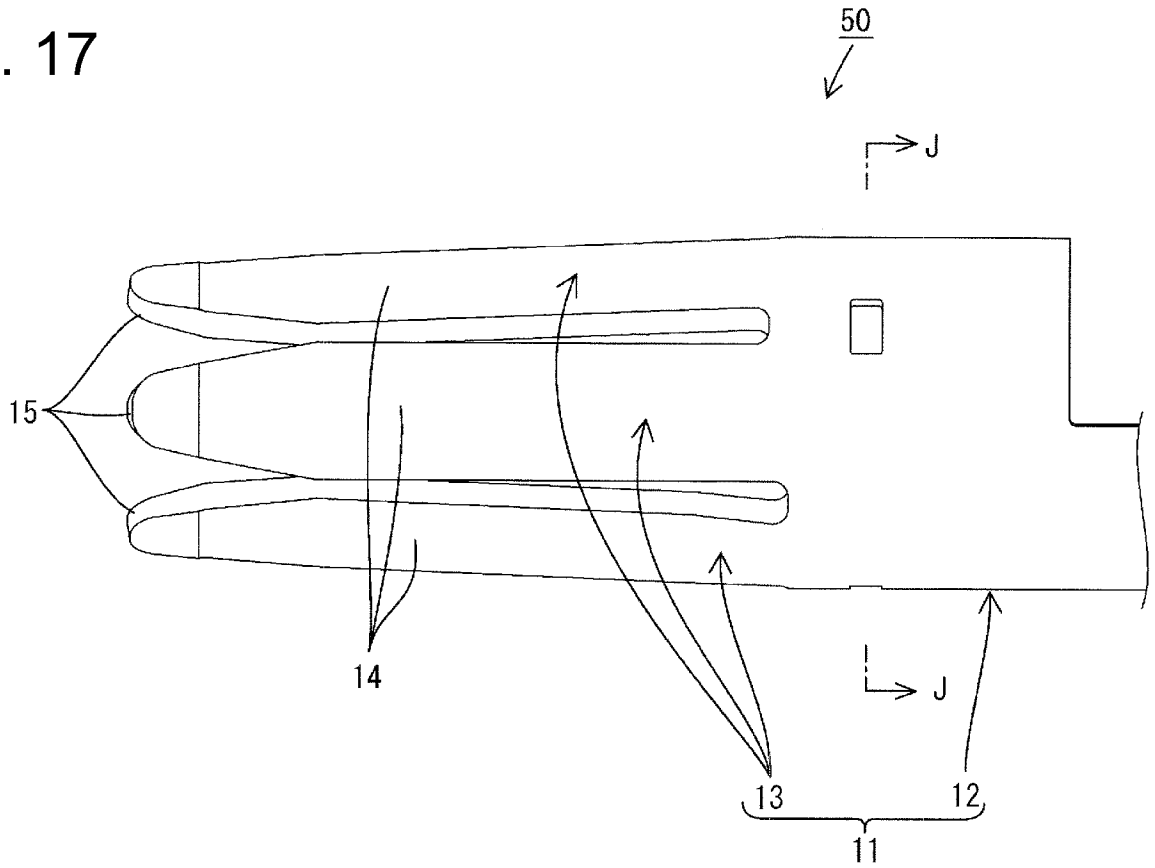
FIG. 17 is a partial side view of a socket terminal in a fourth embodiment of the present invention.
Figure 18:
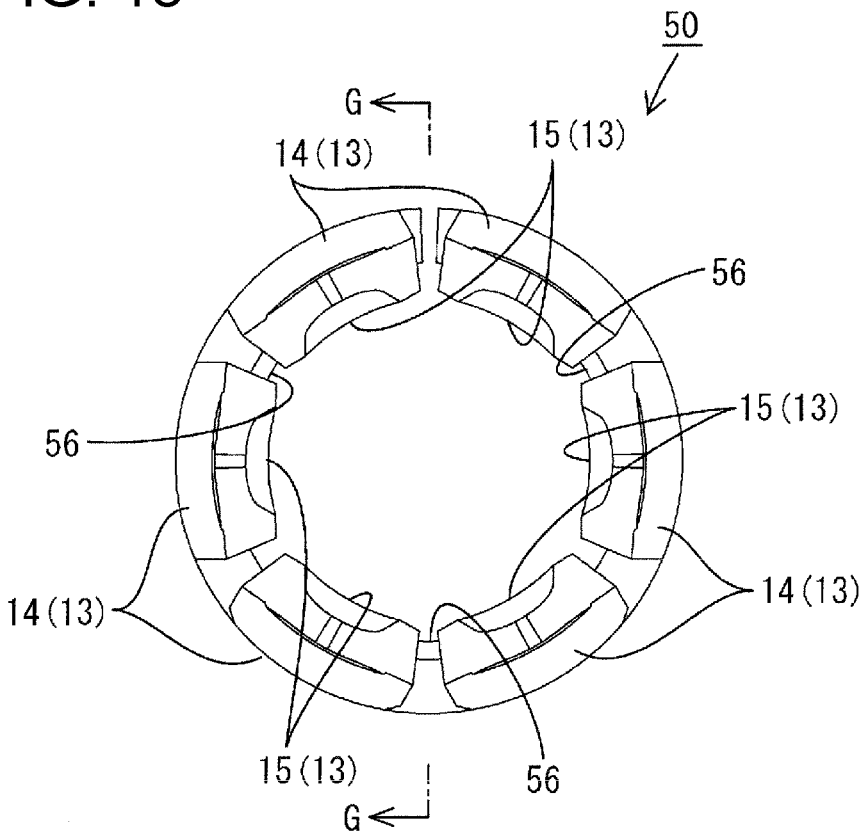
FIG. 18 is a front view of the socket terminal.
Figure 19:
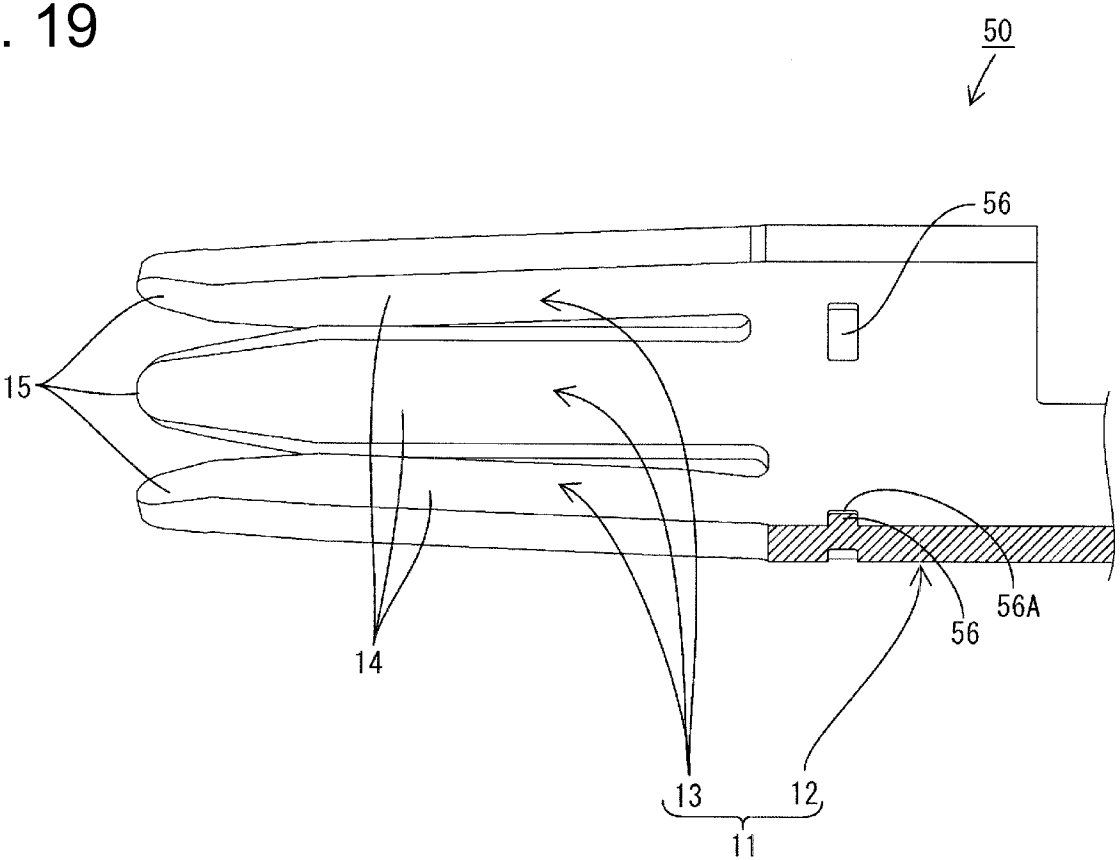
FIG. 19 is a section along Hof FIG. 18.
Figure 20:
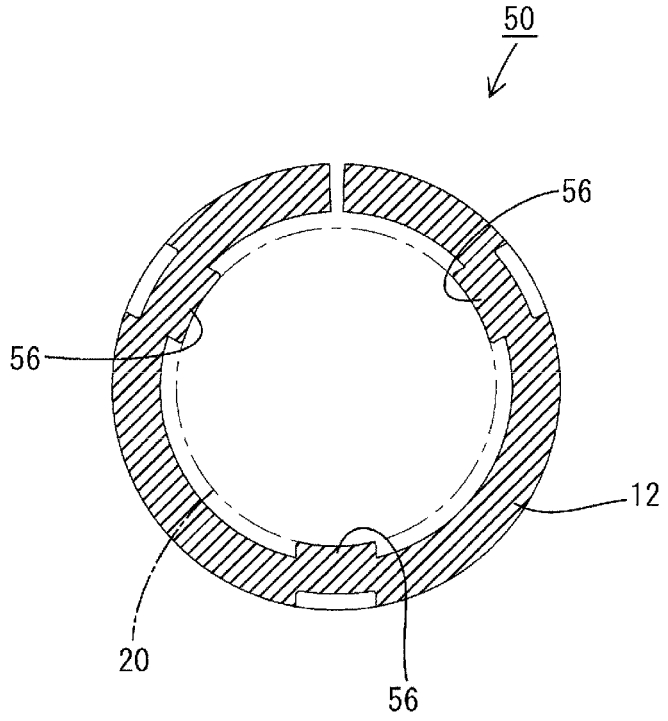
FIG. 20 is a section along J-J of FIG. 17.
Figure 21:
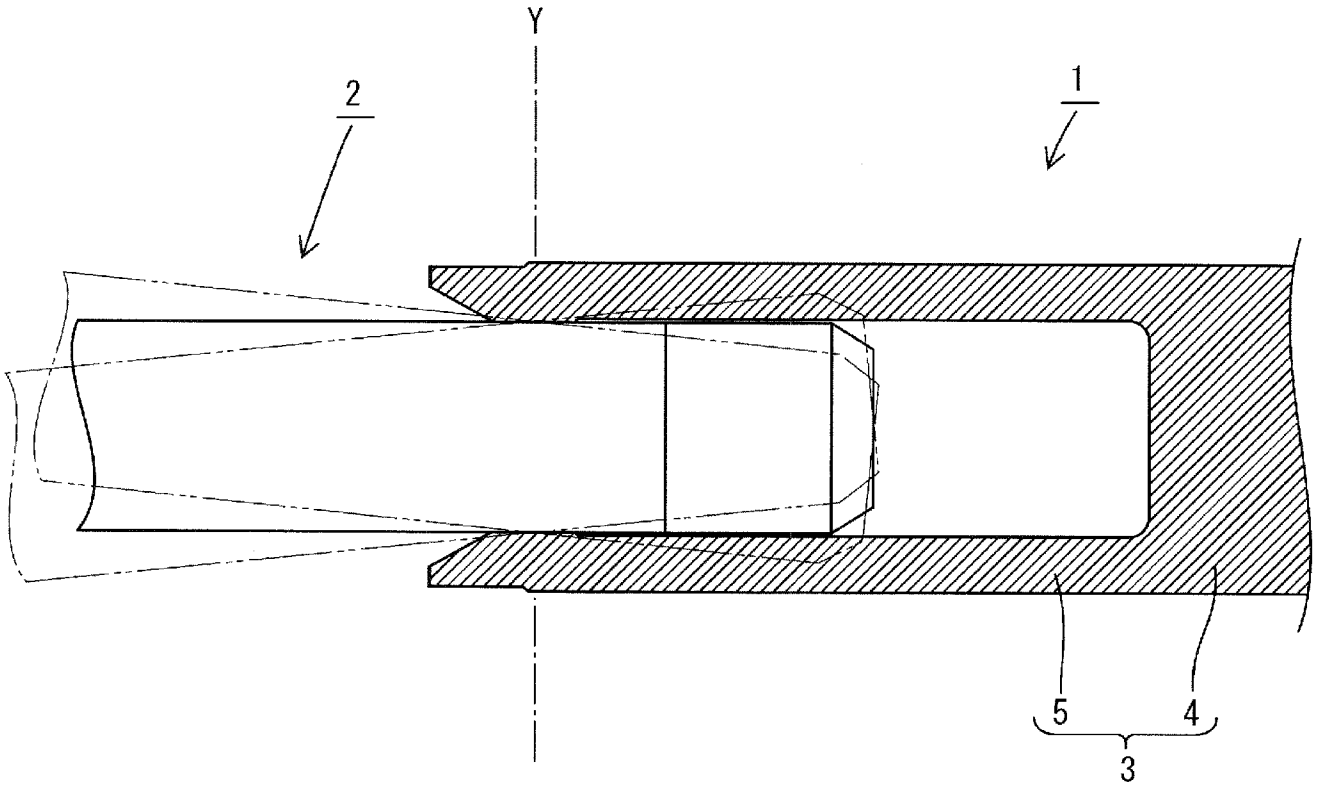
FIG. 21 is a partial side view in section showing a state where a conventional socket terminal and a pin terminal are fitted.

A socket terminal 40 of a third embodiment of the present invention is different from the first and second embodiments in the orientation of resilient holding pieces 46. As shown in FIGS. 13 to 16, the resilient holding pieces 46 are formed by obliquely bending tip parts of resilient pieces cut along an axial direction of a tubular portion 11 and cantilevered forward in a fitting direction radially outwardly of the tubular portion 11. As in the second embodiment, a total of three resilient holding pieces 46 are formed at equal intervals in a circumferential direction, i.e. at positions circumferentially spaced apart by 120°. Further, as shown in FIG. 15, the resilient holding pieces 46 are entirely slightly inclined toward the inside of the tubular portion 11. An inner diameter of a surface formed by connecting bent portions 46A on the tips of the resilient holding pieces 46 in the circumferential direction of the tubular portion 11 is set equal to or slightly smaller than an outer diameter of a pin terminal 20.

Also by such a socket terminal 40 of this embodiment, the pin terminal 20 and the socket terminal 40 can be stably electrically connected as in the above first and second embodiments.

A socket terminal 50 of a fourth embodiment of the present invention is different from the first to third embodiments in the shape of resilient holding pieces.

As shown in FIGS. 17 to 20, in this embodiment, convex bulging portions 56 for holding the outer peripheral surface of a pin terminal 20 are formed on the inner peripheral surface of a base portion 12. The bulging portions 56 are formed by pressing the base portion 12 radially inwardly. Further, a total of three bulging portions 56 are formed at positions spaced apart by 120° in a circumferential direction of a tubular portion 11. An inner diameter of a surface formed by connecting end surfaces 56A of the bulging portions 56 in the circumferential direction of the tubular portion 11 is set substantially equal to an outer diameter of a pin terminal 20.

Also by such a socket terminal 50 of this embodiment, the pin terminal 20 and the socket terminal 50 can be stably electrically connected as in the above first to third embodiments.

The present invention is not limited to the above described and illustrated embodiments. For example, the following embodiments are also included in the technical scope of the present invention.

Although six terminal pieces 13 are illustrated in each of the above embodiments, the number of the terminal pieces 13 is not limited to that of the above embodiments.

Although a total of three resilient holding pieces 16, 36, 46 or bulging portions 56 are formed at the positions spaced apart by 120° in the circumferential direction of the tubular portion 11 in each of the above embodiments, the positions and number of these are not limited to those of the above embodiments.

Although the resilient holding pieces 16, 36, 46 or the bulging portions 56 are located on the axis lines between adjacent ones of the terminal pieces 13, 13 in each of the above embodiments, they may be provided on center lines of the terminal pieces 13 or at other positions and the positions thereof are not limited to those in the above embodiments.

Although the resilient holding pieces 16, 36, 46 or the bulging portions 56 are provided on the same circumference of the base portion 12 in each of the above embodiments, they may be provided at positions displaced in the axial direction of the tubular portion 11.

Although the bulging portions 56 are convex in the above fourth embodiment, they may be, for example, semispherical projections to be brought into point contact with the pin terminal 20.

Although holding portions (resilient holding pieces 16, 36, 46 or bulging portions 56) are provided on the socket terminal made of metal itself in each of the above embodiments, if the socket terminal made of metal is used by being mounted in a resin housing, the holding portions may be formed in the resin housing.

Although the resilient holding pieces 16, 36, 46 or the bulging portions 56 are electrically insulated from the pin terminal in each of the above embodiments, they may be electrically connected to the pin terminal by shortening the insulating member.

LIST OF REFERENCE SIGNS

10, 30, 40, 50: socket terminal
11: tubular portion
12: base portion
13: terminal piece
14: tapered portion
15: guiding portion
16, 36, 46: resilient holding piece (holding portion, resilient piece)
20: pin terminal
21: guiding surface
22: insulating member
56: bulging portion (holding portion)

The invention claimed is:

1. A socket terminal including a tubular portion with opposite front and rear ends, the tubular portion being configured to be fit and connected to a mating pin terminal inserted into the tubular portion from the front end, the tubular portion comprising:

a base portion provided at the rear end of the tubular portion, the base portion having an inner circumferential surface;

a plurality of holding portions projecting radially inward from the inner circumferential surface of the base portion and configured to hold an outer peripheral surface of the pin terminal at a leading end thereof, the holding portions being resiliently deformable radially outward; and a plurality of terminal pieces integral with the base portion and extending in an axial direction of the tubular portion from the base portion toward the front end, the terminal pieces being spaced apart in a circumferential direction of the tubular portion and capable of resiliently contacting the outer peripheral surface of the pin terminal fit in the tubular portion.

2. The socket terminal of 1, wherein the holding portions are provided between adjacent ones of the terminal pieces of the base portion.

3. The socket terminal of claim 1, wherein the pin terminal and the holding portions are in an electrically insulated state.

4. The socket terminal of claim 1, wherein the holding portions are cut from areas of the base portion between opposite longitudinal ends of the base portion and are bent to project radially inward.

5. The socket terminal of claim 4 wherein the holding portions are bent about bend lines in that are substantially parallel to a longitudinal axis of the tubular portion.

6. The socket terminal of claim 4 wherein the holding portions are bent about bend lines in that are transverse to a longitudinal axis of the tubular portion.

7. The socket terminal of claim 1, wherein the terminal pieces are cantilevered forward from the base portion.

8. A socket terminal including a tubular portion with opposite front and rear ends, the tubular portion being configured to be fit and connected to a mating pin terminal inserted into the tubular portion from the front end, the tubular portion comprising:

a base portion provided at the rear end of the tubular portion;

a plurality of terminal pieces integral with the base portion and extending in an axial direction of the tubular portion from the base portion toward the front end, the terminal pieces being spaced apart in a circumferential direction of the tubular portion and capable of resiliently contacting the outer peripheral surface of the pin terminal fit in the tubular portion; and a plurality of holding portions projecting radially in from the base portion and configured to hold an outer peripheral surface of the pin terminal, the holding portions being resilient pieces that are resiliently deformable radially outward of the base portion, wherein the pin terminal and the holding portions are in an electrically insulated state.

9. The socket terminal of claim 8, wherein the plurality of holding portions are provided on a common circumference of an inner peripheral surface of the base portion.

10. The socket terminal of claim 8, wherein the holding portions are cut from areas of the base portion between opposite longitudinal ends of the base portion and are bent to project radially inward.

11. The socket terminal of claim 10 wherein the holding portions are bent about bend lines in that are substantially parallel to a longitudinal axis of the tubular portion.

12. The socket terminal of claim 10 wherein the holding portions are bent about bend lines in that are transverse to a longitudinal axis of the tubular portion.

13. A socket terminal including a tubular portion with opposite front and rear ends, the tubular portion being configured to be fit and connected to a mating pin terminal inserted into the tubular portion from the front end, the tubular portion comprising:

a base portion provided at the rear end of the tubular portion;

a plurality of terminal pieces integral with the base portion and extending in an axial direction of the tubular portion from the base portion toward the front end, the terminal pieces being spaced apart in a circumferential direction of the tubular portion and capable of resiliently contacting the outer peripheral surface of the pin terminal fit in the tubular portion; and a plurality of resiliently deformable holding portions cut from areas of the base portion between opposite longitudinal ends of the base portion and bent to project radially inward from the base portion while being resiliently deformable radially outward, the plurality of holding portions configured to hold an outer peripheral surface of the pin terminal.

14. The socket terminal of claim 13, wherein the holding portions are cut from areas of the base portion between opposite longitudinal ends of the base portion and are bent to project radially inward.

15. The socket terminal of claim 14, wherein the holding portions are bent about bend lines in that are substantially parallel to a longitudinal axis of the tubular portion.

16. The socket terminal of claim 14, wherein the holding portions are bent about bend lines in that are transverse to a longitudinal axis of the tubular portion.

* * * * *